US012687297B2

(12) United States Patent
Shershnyov

(10) Patent No.: US 12,687,297 B2
(45) Date of Patent: Jul. 21, 2026

(54) COMBUSTOR HAVING AN ADDITIONAL COOLING COMPONENT FOR LINER AND GAS TURBINE INCLUDING SUCH COMBUSTOR

(71) Applicant: DOOSAN ENERBILITY CO., LTD., Changwon (KR)

(72) Inventor: Borys Shershnyov, Changwon (KR)

(73) Assignee: DOOSAN ENERBILITY CO., LTD, Changwon (KR)

( * ) Notice: Subject to any disclaimer, the term of this patent is extended or adjusted under 35 U.S.C. 154(b) by 0 days.

(21) Appl. No.: 19/245,047

(22) Filed: Jun. 20, 2025

(65) Prior Publication Data

US 2026/0009538 A1 Jan. 8, 2026

(30) Foreign Application Priority Data

Jul. 3, 2024 (KR) ..... 10-2024-0087354

(51) Int. Cl.
*F23R 3/00* (2006.01)

(52) U.S. Cl.
CPC .... *F23R 3/002* (2013.01); *F23R 2900/03043* (2013.01)

(58) Field of Classification Search
None
See application file for complete search history.

(56) References Cited

U.S. PATENT DOCUMENTS 11,692,708 B1 * 7/2023 Sampath ..... F23R 3/002 60/748
2009/0120093 A1 * 5/2009 Johnson ..... F01D 9/023 60/752
2011/0214429 A1 9/2011 Chen
2011/0252805 A1 * 10/2011 Berry ..... F23R 3/44 60/760

(Continued)

FOREIGN PATENT DOCUMENTS

EP 2226564 A2 9/2010
EP 2481983 A2 8/2012

(Continued)

OTHER PUBLICATIONS

Extended European Search Report Dated Nov. 3, 2025 Issued for EP Patent Application 25185232.3-1002.

(Continued)

*Primary Examiner* — Phutthiwat Wongwian
*Assistant Examiner* — Jacek Lisowski
(74) *Attorney, Agent, or Firm* — Harvest IP Law, LLP

(57) ABSTRACT

A combustor includes a liner configured to define a combustion chamber and extending in a longitudinal direction, a transition piece configured to overlap an end of the liner while being spaced apart from the end of the liner at a predetermined spacing distance, the transition piece extending in the longitudinal direction of the liner, and a shroud disposed between the liner and the transition piece and coupled to the liner, in which the liner and an inner surface of the shroud define a cooling flow path, and in which the (Continued)

cooling flow path is formed with a turbulator to allow the air, which flows in the cooling flow path, to flow as a turbulent flow in order to dissipate heat from the liner.

18 Claims, 14 Drawing Sheets

(56) References Cited

U.S. PATENT DOCUMENTS

| | | | | |
|---|---|---|---|---|
| 2012/0247111 | A1* | 10/2012 | Narcus | F23R 3/002 60/752 |
| 2019/0107054 | A1* | 4/2019 | Park | F02C 7/18 |
| 2020/0103114 | A1 | 4/2020 | Simmons | |
| 2023/0167747 | A1 | 6/2023 | Nagahashi | |

FOREIGN PATENT DOCUMENTS

| | | | |
|---|---|---|---|
| EP | 2532962 | A2 | 12/2012 |
| JP | H09-196377 | A | 7/1997 |
| JP | 2009-085222 | A | 4/2009 |
| JP | 2023-050552 | A | 4/2023 |
| KR | 10-1812883 | B1 | 12/2017 |
| KR | 10-2018-0014953 | A | 2/2018 |
| KR | 10-2019-0083079 | A | 7/2019 |

OTHER PUBLICATIONS

Office Action From Korean Patent Office Dated Nov. 18, 2025 Issued for Korean Patent Application No. 10-2024-0087354.

The Office Action issued on May 7, 2026 for the corresponding Japanese Patent Application.

* cited by examiner

COMBUSTOR HAVING AN ADDITIONAL COOLING COMPONENT FOR LINER AND GAS TURBINE INCLUDING SUCH COMBUSTOR

CROSS-REFERENCE TO RELATED APPLICATION

This application claims priority to and the benefit of Korean Patent Application No. 10-2024-0087354 filed in the Korean Intellectual Property Office on Jul. 3, 2024, the entire contents of which are incorporated herein by reference.

TECHNICAL FIELD

The present disclosure relates to a combustor and a gas turbine including the same. More specifically, the present disclosure relates to a combustor, which is configured to form a turbulent flow in a cooling flow path configured to cool a liner of a combustor, and a gas turbine including the same.

BACKGROUND ART

A gas turbine refers to a power engine that mixes compressed air, which is compressed by a compressor, with fuel, combusts the air-fuel mixture, and rotates a turbine with a high-temperature gas produced by the combustion. The gas turbines are used to operate generators, aircraft, ships, trains, and the like.

In general, the gas turbine includes a compressor, a combustor, and a turbine. The compressor sucks and compresses outside air and transmits the compressed air to the combustor. The air compressed by the compressor is in a high-pressure, high-temperature state. The combustor mixes the compressed air, which is introduced from the compressor, with fuel and combusts the air-fuel mixture. The combustion gas generated by the combustion is discharged to the turbine. Turbine blades in the turbine are rotated by the combustion gas, thereby generating power. The generated power is used in various fields such as power generation and operations of mechanical devices.

A combustion chamber of the combustor may be exposed to a high-temperature environment. A liner, which defines the combustion chamber, needs to be prevented from being melted or damaged by a high temperature in the combustion chamber. To this end, a cooling flow path, through which a cooling fluid may flow, may be provided outside the liner in order to cool the liner. The cooling fluid, particularly air, which passes through the cooling flow path, may move to the combustion chamber and supply oxygen required for combustion.

However, in case that an excessively large amount of air is provided to the cooling flow path, a part of the air, which needs to be used to generate electric power in the turbine, is allowed to flow to the cooling flow path and serve as the cooling fluid. For this reason, there may occur a problem in that the amount of power generation decreases. Further, in case that an excessively large amount of air is introduced into the combustion chamber, a large amount of nitrogen oxide (NOx) is produced, which contaminates the environment.

SUMMARY

The present disclosure has been made in an effort to improve cooling efficiency of a cooling fluid flowing along a cooling flow path. The present disclosure has also been made in an effort to reduce the amount of production of nitrogen oxide by reducing the amount of a cooling fluid flowing along a cooling flow path.

Technical problems to be solved by the present document are not limited to the above-mentioned technical problems, and other technical problems, which are not mentioned above, may be clearly understood from the following descriptions by those skilled in the art to which the present disclosure pertains.

A combustor according to an embodiment of the present disclosure includes: a liner configured to define a combustion chamber and extending in a longitudinal direction; a transition piece configured to overlap an end of the liner while being spaced apart from the end of the liner at a predetermined spacing distance, the transition piece extending in the longitudinal direction of the liner; and a shroud disposed between the liner and the transition piece and coupled to the liner, in which the liner and an inner surface of the shroud define a cooling flow path, and in which the cooling flow path is formed with a turbulator to allow the air, which flows in the cooling flow path, to flow as a turbulent flow in order to dissipate heat from the liner.

The turbulator may protrude from the liner or the inner surface of the shroud toward the cooling flow path.

The turbulator may be included in the liner, the liner may include a flow path forming portion configured to define the cooling flow path, and the turbulator may protrude from the flow path forming portion.

The turbulator may be formed to protrude perpendicularly to a longitudinal direction of the cooling flow path.

The turbulator may be provided as a plurality of turbulators arranged at predetermined intervals in a longitudinal direction of the cooling flow path.

When a length by which each of the plurality of turbulators protrudes may be defined as e, and an interval between the plurality of turbulators may be defined as p, a ratio of e to p may be 8 or more and 10 or less.

The shroud may include a swirler in an inlet flow path to form a swirl in the inlet flow path, which communicates with an inlet of the cooling flow path.

An inner surface of the swirler may define the inlet flow path, and the inlet flow path may have a longitudinal direction inclined with respect to an extension direction of the cooling flow path.

The inlet flow path may have an extension direction that is a direction made by combining two directions perpendicular to a longitudinal direction of the cooling flow path.

A distance between two farthest points on a cross-sectional area of the swirler may be equal to or larger than a height of the cooling flow path.

An outlet flow path of the cooling flow path may extend in a longitudinal direction of the cooling flow path.

At least a part of the cooling flow path may have a section in which a cross-sectional area decreases in a direction from an upstream side to a downstream side based on a direction in which a cooling fluid configured to flow along the cooling flow path flows in the cooling flow path.

The section in which the cross-sectional area of the cooling flow path decreases may be provided by forming a stepped portion.

The turbulator may protrude from the liner or the inner surface of the shroud toward the cooling flow path, in which the section in which the cross-sectional area of the cooling flow path decreases corresponds to a section in which the turbulator is formed.

The combustor may further include: a strut disposed at a rear side of the liner and between the shroud and the liner and configured to support the shroud and the liner.

A combustor according to another embodiment of the present disclosure may include: a liner configured to define a combustion chamber and extending in a longitudinal direction; a transition piece configured to overlap an end of the liner while being spaced apart from the end of the liner at a predetermined spacing distance, the transition piece extending in the longitudinal direction of the liner; and a shroud disposed between the liner and the transition piece and coupled to the liner, in which the liner and an inner surface of the shroud define a cooling flow path, and in which at least a part of the cooling flow path has a section in which a cross-sectional area gradually decreases in a direction from an upstream side to a downstream side.

The section in which the cross-sectional area of the cooling flow path decreases may be provided by forming a stepped portion.

The combustor may further include: a turbulator protruding from the liner or the inner surface of the shroud toward the cooling flow path, in which the section in which the cross-sectional area of the cooling flow path decreases corresponds to a section in which the turbulator is formed.

The shroud may include a swirler in an inlet flow path to form a swirl in the inlet flow path, which communicates with an inlet of the cooling flow path.

A gas turbine according to still another embodiment of the present disclosure includes: a compressor; a turbine configured to produce electric power by using air compressed by the compressor; and a combustor configured to combust the air compressed by the compressor, in which the combustor includes: a liner configured to define a combustion chamber and extending in a longitudinal direction; a transition piece configured to overlap an end of the liner while being spaced apart from the end of the liner at a predetermined spacing distance, the transition piece extending in the longitudinal direction of the liner; and a shroud disposed between the liner and the transition piece and coupled to the liner, in which the liner and an inner surface of the shroud define a cooling flow path, and in which the cooling flow path is formed with a turbulator to allow the air, which flows in the cooling flow path, to flow as a turbulent flow in order to dissipate heat from the liner.

According to the combustor according to the embodiment of the present disclosure, the cooling flow path configured to form a turbulent flow is formed, which may improve the efficiency in cooling the liner.

According to the combustor according to the embodiment of the present disclosure, the cooling flow path with the improved cooling efficiency may allow a small amount of air to flow to the combustion chamber, which may reduce the production of nitrogen oxide.

According to the combustor according to the embodiment of the present disclosure, the cooling flow path having the cross-sectional area, which decreases in the flow direction, is formed, which may reduce the amount of air flowing to the combustion chamber.

The gas turbine according to the embodiment of the present disclosure includes the above-mentioned combustor, thereby obtaining the above-mentioned effects.

The effects obtained by the present disclosure are not limited to the aforementioned effects, and other effects, which are not mentioned above, will be clearly understood by those skilled in the art from the following description.

DETAILED DESCRIPTION

Figure 1:
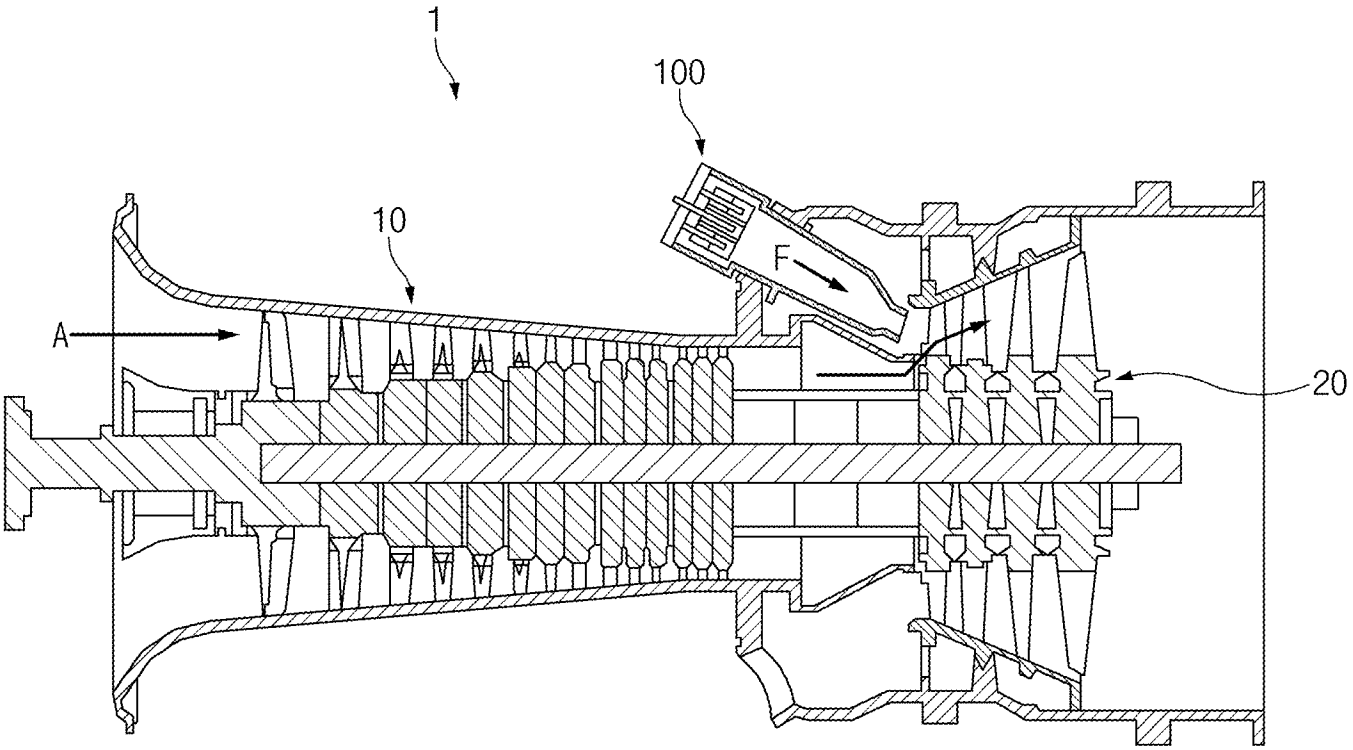
FIG. 1 is a cross-sectional view of a gas turbine according to a first embodiment of the present disclosure.

Hereinafter, exemplary embodiments of the present disclosure will be described in detail with reference to the accompanying drawings so that those with ordinary skill in the art to which the present disclosure pertains may easily carry out the embodiments. However, the present disclosure may be implemented in various different ways and is not limited or restricted by the embodiments described herein.

A part irrelevant to the description will be omitted to clearly describe the present disclosure. Further, the specific descriptions of publicly known related technologies will be omitted when it is determined that the specific descriptions may unnecessarily obscure the subject matter of the present disclosure. In assigning reference numerals to constituent elements of the respective drawings in the present specification, the same or similar constituent elements will be designated by the same or similar reference numerals throughout the specification.

In addition, terms or words used in the specification and the claims should not be interpreted as being limited to a general or dictionary meaning and should be interpreted as a meaning and a concept which conform to the technical spirit of the present disclosure based on a principle that an inventor can appropriately define a concept of a term in order to describe his/her own invention by the best method.

Various embodiments of the present document and the terms used in the embodiments are not intended to limit the technical features disclosed in the present document to the particular embodiments and should be understood as including various alterations, equivalents, or alternatives of the corresponding embodiments.

In connection with the description of the drawings, the same or similar reference numerals may be used for the similar or relevant components.

A singular form of a noun corresponding to an item may include one or more of the items, unless the relevant context clearly indicates otherwise.

As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases.

The term "and/or" includes any and all combinations of a plurality of related and listed components.

As used herein, such terms as "1st" and "2nd," or "first" and "second" may be used to simply distinguish a corresponding component from another, and does not limit the components in other aspect (e.g., importance or order).

If an element (e.g., a first element) is referred to, with or without the term "operatively" or "communicatively," as "coupled with," "coupled to," "connected with," or "connected to" another element (e.g., a second element), it means that the element may be coupled with the other element directly (e.g., wiredly), wirelessly, or via a third element.

The terms "including" and "having" are intended to designate the existence of characteristics, numbers, steps, operations, constituent elements, and components described in the present document or a combination thereof, and do not exclude a possibility of the existence or addition of one or more other characteristics, numbers, steps, operations, constituent elements, and components, or a combination thereof in advance.

When one constituent element is "connected to," coupled to," "supported on," or "in contact with" another constituent element, the constituent elements may be directly connected to, coupled to, supported on, or in contact with each other, and one constituent element may be indirectly connected to, coupled to, supported on, or in contact with another constituent element by means of a third constituent element.

When one constituent element is positioned "on" another constituent element, one constituent element may adjoin another constituent element, and still another constituent element may be present between the two constituent elements.

Meanwhile, the terms "upward/downward direction," "lower side," "forward/rearward direction," and the like used in the following description are defined based on the drawings and the description provided in this specification, and shapes and positions of the constituent elements are not limited by the terms.

Hereinafter, embodiments according to the present disclosure will be described in detail with reference to the accompanying drawings.

First Embodiment

Figure 2:
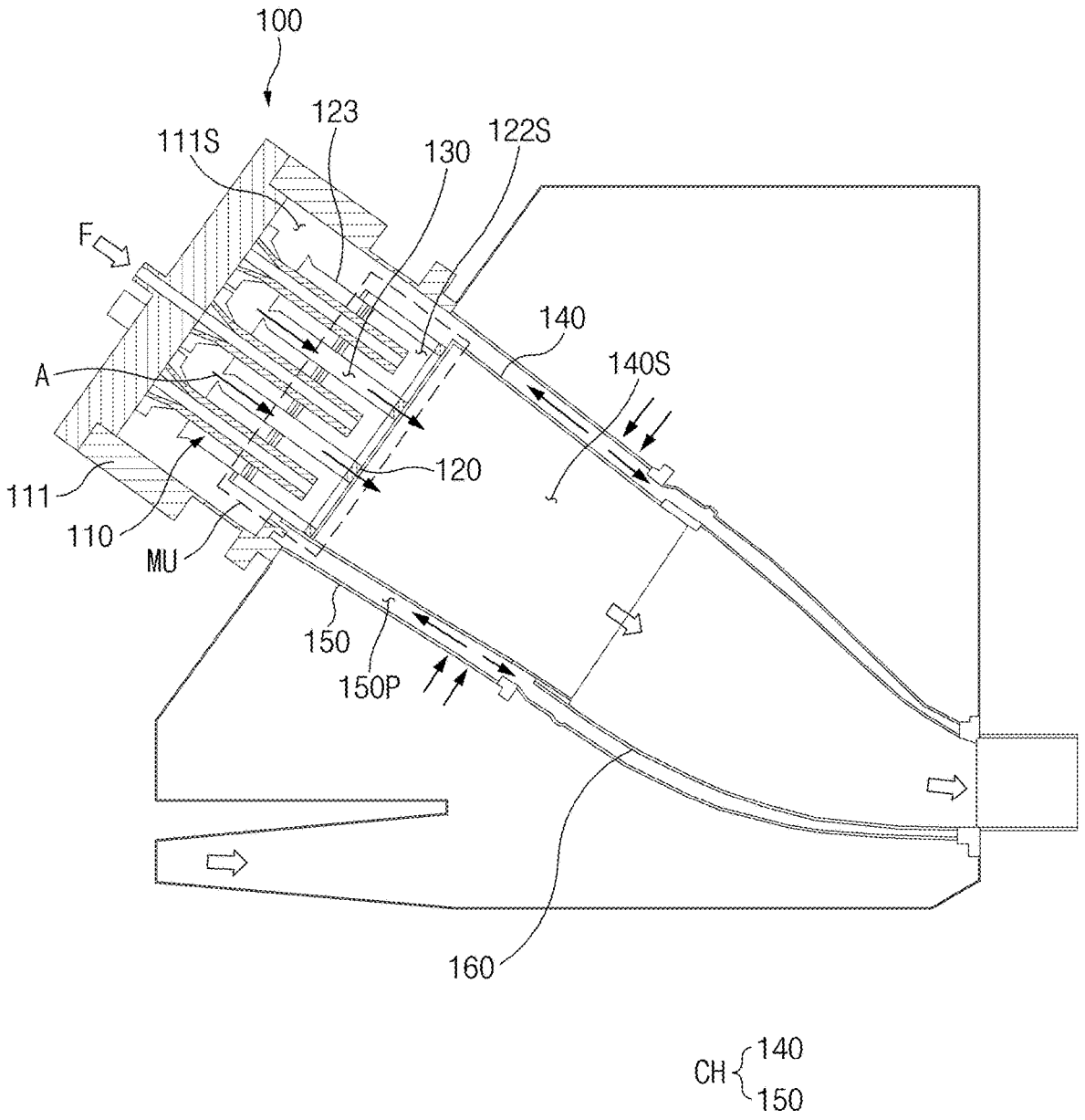
FIG. 2 is a cross-sectional view of a combustor illustrated in FIG. 1.

FIG. 1 is a cross-sectional view of a gas turbine 1 according to a first embodiment of the present disclosure. FIG. 2 is a cross-sectional view of a combustor 100 illustrated in FIG. 1.

The gas turbine 1 may be used to generate electric power. The gas turbine 1 may generate power by means of combustion of gas. A thermodynamic cycle of the gas turbine 1 may ideally follow the Brayton cycle. The Brayton cycle includes four processes including isentropic compression (adiabatic compression), isobaric heating, isentropic expansion (adiabatic expansion), and isobaric heat dissipation. That is, this cycle may suck atmospheric air, compress the air into high-pressure air, combust fuel in a constant-pressure environment, release heat energy generated by combustion, expand high-temperature combustion gas to generate kinetic energy, and then release exhaust gas containing residual energy into the atmosphere. That is, the cycle may include four processes including compression, heating, expansion, and heat dissipation.

As illustrated in FIG. 1, the gas turbine 1, which realizes the Brayton cycle, may include a compressor 10, the combustor 100, and a turbine 20. The following description will be described with reference to FIG. 1. However, the description of the present disclosure may also be widely applied to various turbine engines that are equivalent in configuration to the gas turbine 1 exemplarily illustrated in FIG. 1.

With reference to FIG. 1, the compressor 10 of the gas turbine 1 may suck air from the outside and compress the air. The compressor 10 may supply compressed air, which is compressed by compressor blades of the compressor 10, to the combustor 100 and supply cooling air to a high-temperature region of the gas turbine 1 required to be cooled. In this case, the sucked air undergoes an adiabatic compression process in the compressor 10, such that the air having passed through the compressor 10 increases in pressure and temperature.

The compressor 10 is designed as a centrifugal compressor 10 or an axial compressor 10. The centrifugal compressor 10 is typically applied to a small-scale gas turbine 1. In contrast, because the large-scale gas turbine 1 illustrated in FIG. 1 needs to compress a large amount of air, the large-scale gas turbine 1 generally adopts a multi-stage axial compressor 10. In this case, in the multi-stage axial compressor 10, the compressor blades of the compressor 10 compresses the introduced air while being rotated by a rotation of a rotor disc and moves the compressed air to a rear end thereof. The air is gradually compressed into the air with higher pressure while passing over the compressor blades of the compressor 10 that are provided in multiple stages.

The compressor 10 may operate using a part of power outputted from the turbine 20. To this end, as illustrated in FIG. 1, a rotary shaft of the compressor 10 and a rotary shaft of the turbine 20 may be connected directly to each other. In the case of the large-scale gas turbine 1, approximately half of the output produced by the turbine 20 may be consumed to operate the compressor 10. Therefore, the improvement in the efficiency of the compressor 10 directly affects the improvement in overall efficiency of the gas turbine 1.

The turbine 20 may generate power using gas produced by combustion in the combustor 100. The gas, which moves in the turbine 20, may rotate turbine blades of the turbine 20, thereby generating electric power.

The combustor 100 may mix the compressed air, which is supplied from an outlet of the compressor 10, with fuel and combust the air-fuel mixture under an isobaric condition, thereby producing high-energy combustion gas. As illustrated in FIG. 2, the combustor 100 may include nozzles 110, a nozzle housing 111, and/or a housing of the combustor 100.

The nozzle housing 111 may accommodate the nozzle 110 while surrounding the nozzle 110. The nozzle housing 111 may have an approximately circular cylindrical shape. The nozzle 110 may be positioned at a downstream side of the compressor 10 and disposed along the nozzle housing 111 having an annular shape. The fuel and the air, which are mixed at an appropriate ratio, are injected from the nozzle 110, such that the fuel and the air may be suitable for combustion. That is, the nozzle 110 may be configured to produce a flame. Further, the nozzle housing 111 may define an air chamber configured such that air is introduced into the air chamber. More specifically, as described below, the air, which moves along an outer surface of the housing of the combustor 100 from the compressor 10, may be introduced into the air chamber of the nozzle housing 111. The air introduced into the air chamber may be supplied to the nozzle 110 and mixed with air so that the nozzle 110 produces a flame. Further, the air introduced into the air chamber moves toward an effusion plate positioned at a downstream side of the air chamber and will be described below. The air may cool the effusion plate.

The housing of the combustor 100 may define therein a combustion chamber 140S in which a combustion reaction occurs to combust the gas. Further, the housing of the combustor 100 may connect the nozzle 110 and the turbine 20 and transmit the gas, which has been combusted by the nozzle 110, to the turbine 20. The housing of the combustor 100 may connect the nozzle 110 and the turbine 20, such that a high-temperature combustion gas may flow in the housing of the combustor 100. In this case, the compressed air flows along the outer surface of the housing of the combustor 100 and is supplied to the nozzle 110. During this process, the housing of the combustor 100, which is heated by the high-temperature combustion gas, may be appropriately cooled. Additionally, in this case, the compressed air may be understood as a cooling fluid in addition to serving as a combustion reactant.

More specifically, the housing of the combustor 100 may include a liner 140 configured to define the combustion chamber 140S, and a transition piece 160 (see FIG. 2) configured to move and guide the flame, which is produced in the combustion chamber 140S and propagates, toward the turbine 20. That is, the liner 140 may be positioned adjacent to the nozzle 110 and positioned at an upstream side based on a direction in which the flame propagates. The transition piece 160 may be configured to be positioned at a downstream side of the liner 140. In other words, the liner 140 may define the combustion chamber 140S and extend in a longitudinal direction. The transition piece 160 may overlap an end of the liner 140 while being spaced apart from the end of the liner 140 at a predetermined spacing distance. The transition piece 160 may extend in the longitudinal direction of the liner 140. Because the liner 140 and the transition piece 160 are positioned inside the housing of the combustor 100, the liner 140 and the transition piece 160 may be referred to as inner housings. Additionally, the liner 140 and the transition piece 160 may extend in the longitudinal direction while having circular cross-sections. That is, it can be seen that the liner 140 and the transition piece 160 have tubular shapes.

In the tubular shape of the liner 140, the longitudinal direction may mean the extension direction of the liner 140 along the flow of the combustion gas from the nozzles toward the transition piece 160. In the longitudinal direction of the liner 140, the direction toward the nozzles from the transition piece may be referred to as a front side of the longitudinal direction while the opposite direction may be referred to as a rear side of the longitudinal direction. Also, a direction along the circular peripheral of the liner 140 may be referred to as a circumferential direction, and a direction from the center of the combustion chamber 140S toward the circular peripheral of the liner 140 may be referred to as a radial direction. The radial direction may be perpendicular to the longitudinal direction and the circumferential direction.

The housing of the combustor 100 may include a flow sleeve 150 provided outside the liner 140 and the transition piece 160 and configured to cover the liner 140 and the transition piece 160. The flow sleeve 150 may be spaced apart from the liner 140 and the transition piece 160 at a predetermined distance. A flow path is formed between the flow sleeve 150 and the liner 140 or between the flow sleeve 150 and the transition piece 160. As described above, the compressed air flows along the flow path, such that the compressed air may cool the liner 140 and/or the transition piece 160. In this case, a part of the compressed air compressed by the compressor 10 may be discharged and then move to the flow path, which is formed between the flow sleeve 150 and the liner 140 or between the flow sleeve 150 and the transition piece 160, through a hole formed in the flow sleeve 150. In particular, because the liner 140 and the transition piece 160 are the parts that come into contact with the flame formed by the combustion of fuel injected from the nozzle 110, temperatures of the liner 140 and the transition piece 160 may rise. Therefore, the liner 140 and the transition piece 160 may need to be cooled. The liner 140 and the transition piece 160 may be made of a metallic material. In this case, the metal may melt when the temperature of the metal reaches or exceeds a melting point. A temperature equal to or lower than the melting point may need to be maintained so that the liner 140 and the transition piece 160 retain original shapes.

In particular, because a rear end portion (i.e., downstream end portion) of the liner 140 is a portion where the flame matures, the problem of temperature increase due to the flame may be most severe at the rear end portion of the liner 140. Therefore, the rear end portion of the liner 140 may need intensive cooling. A configuration for cooling the liner 140 will be described below more in detail.

Figure 3:
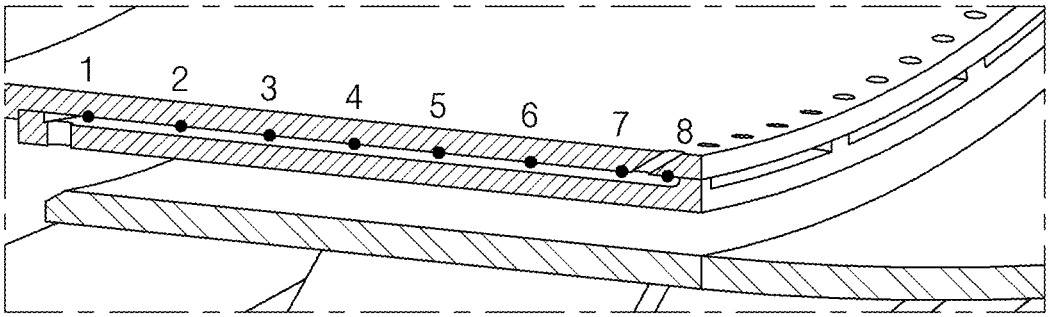
FIG. 3 is a cross-sectional perspective view of a comparative example of a part corresponding to a rear end portion of a liner in the combustor illustrated in FIG. 2.

FIG. 3 is a cross-sectional perspective view of a comparative example (i.e. a conventional system) of a part corresponding to the rear end portion of the liner illustrated in FIG. 2.

The comparative example will be described with reference to FIG. 3. The following description of the comparative example is provided to facilitate the understanding of the invention of the present disclosure. Therefore, the description of the comparative example is not intended to limit the scope of protection of the present disclosure or to preclude any part from being used as an embodiment.

Further, in the following description, components corresponding to those of the embodiment of the present disclosure will be described using the same reference description as those of the embodiment of the present disclosure. Therefore, the components of the comparative example will be described without assigning separate reference numerals.

In order to cool the rear end portion of the liner, a portion where the liner and the transition piece overlap may be provided. This portion may be referred to as a shroud. Therefore, the compressed air, which moves along the liner and the outer surface of the transition piece, may flow between the liner and the transition piece. Because a portion between the liner and the transition piece may be a portion corresponding to the rear end portion of the liner, the flow of the compressed air in the portion between the liner and the transition piece may assist in transferring heat away from the rear end portion of the liner. In particular, because moving air transfers more heat than stationary air, generating airflow in a portion adjacent to the rear end portion of the liner may help dissipate heat from the rear end portion of the liner.

Here, the shroud may be provided adjacent to the rear end portion of the liner and forms a cooling flow path, through which the cooling fluid flows, between the shroud and the rear end portion of the liner. The shroud may be disposed between the liner and the transition piece and coupled to the liner. The liner and an inner surface of the shroud may define the cooling flow path. Because the cooling flow path extends along the outer surface of the liner, the cooling fluid flowing along the cooling flow path may assist in dissipating heat from the outer surface of the liner. In this case, a portion, referred to as the rear end portion of the liner in the above-mentioned description, i.e., a portion, which contributes to forming the cooling flow path, may also be referred to as a flow path forming portion. The liner may include a flow path forming portion configured to define the cooling flow path.

The shroud may include an inlet flow path connected to an inlet of the cooling flow path. The inlet flow path may extend downward based on FIG. 3 (i.e., in the radial direction). The shroud may define an outlet flow path connected to an outlet of the cooling flow path. For example, based on FIG. 3, the outlet flow path may include a first outlet flow path extending in the longitudinal direction of the liner, and a second outlet flow path extending upward (i.e., radially inward) and toward the combustion chamber. The cooling fluid may flow sequentially through the inlet flow path, the cooling flow path, and the outlet flow path.

With reference to FIG. 3, dots are depicted in the flow path forming portion of the liner. An experiment was conducted to measure temperatures at points corresponding to the dots on the flow path forming portion. The result of the experiment is summarized in the following table on the assumption that the dots are denoted by 1 to 8 along a direction from the left side to the right side based on FIG. 3.

The environmental conditions under which the experiment was performed are as follows.

A turbine inlet temperature (TIT) is 1,650° C., and a temperature of the cooling fluid introduced into the inlet flow path is 493° C. In this case, a target temperature of the liner cooled by the cooling flow path in consideration of a melting point of metal is 815° C. A thickness of thermal barrier coating (TBC) is 1.5 mm. Thermal conductivity of the TBC is 1.2 W/m/C. A mass flow rate of the compressed air used as the cooling fluid is 1.213 kg/s.

TABLE 1

| | Dot number | | | | | | | |
|---|---|---|---|---|---|---|---|---|
| | 1 | 2 | 3 | 4 | 5 | 6 | 7 | 8 |
| Temperature (° C.) | 644 | 725 | 775 | 810 | 832 | 845 | 854 | 864 |

With reference to the result, it can be seen that certain regions have temperatures exceeding the targeted temperature of the liner, which is 815° C. This may cause the following three problems.

First, the temperature of the liner is close to the melting point, which may cause problems such as melting or thermal deformation. Second, the temperature distribution of the liner is steep, which may cause warping due to differences in the amount of deformation at each temperature. Third, if a larger amount of compressed air is allowed to flow through the cooling flow path to resolve the problem, a greater amount of air is injected into the combustion chamber because the compressed air is eventually supplied to the combustion chamber. The increased amount of air may result in in increased production of nitrogen oxide.

The embodiment of the present disclosure, which addresses these problems, will be described below. Before doing so, an experimental result comparing the first embodiment of the present disclosure to the comparative example is provided below. The mass flow rate of the compressed air used as the cooling fluid in the first embodiment is 0.8873 kg/s, which is lower than that used in the comparative example. In the first embodiment, the mass flow rate of the compressed air is numerically less by 0.3257 kg/s than the mass flow rate in the comparative example, and the compressed air is used 0.706 times that used in the comparative example. Further, the cooling effect achieved with the lower mass flow rate is greater, as shown below.

TABLE 2

| | Dot number | | | | | | | | Average |
|---|---|---|---|---|---|---|---|---|---|
| | 1 | 2 | 3 | 4 | 5 | 6 | 7 | 8 | temperature |
| Temperature (° C.) | 644 | 725 | 775 | 810 | 832 | 845 | 854 | 864 | 794 |
| Temperature (° C.) | 750 | 759 | 756 | 731 | 726 | 717 | 698 | 724 | 733 |

Figure 4:
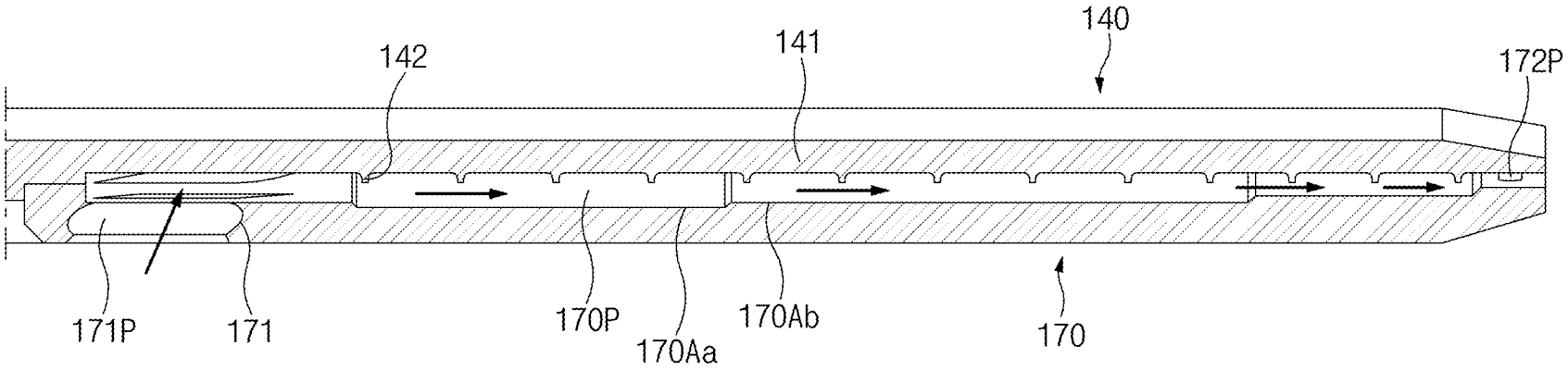
FIG. 4 is an enlarged cross-sectional view illustrating the liner and a shroud at the rear end portion of the liner in the combustor illustrated in FIG. 2.
Figure 5:
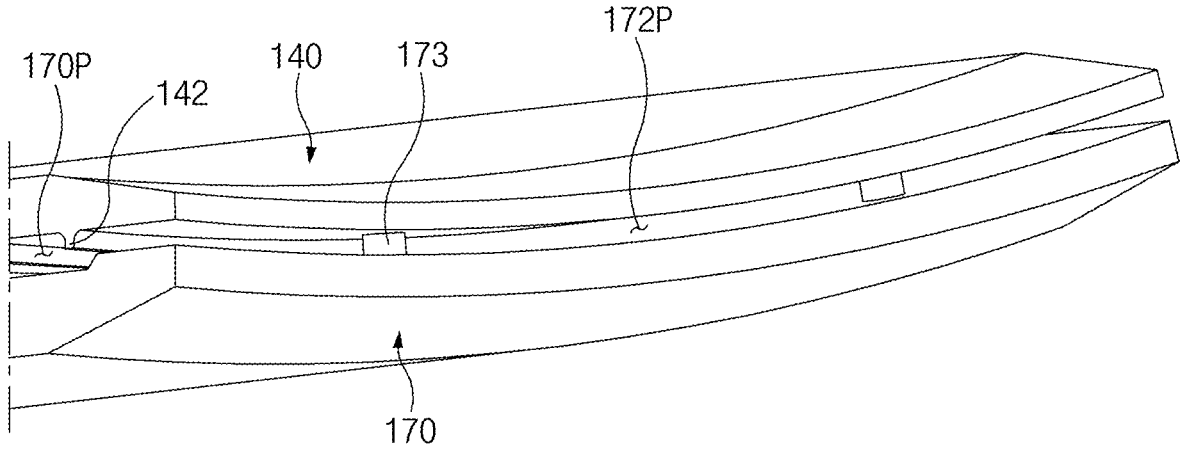
FIG. 5 is an enlarged perspective view illustrating an end of the liner and an end of the shroud illustrated in FIG. 4.
Figure 6:
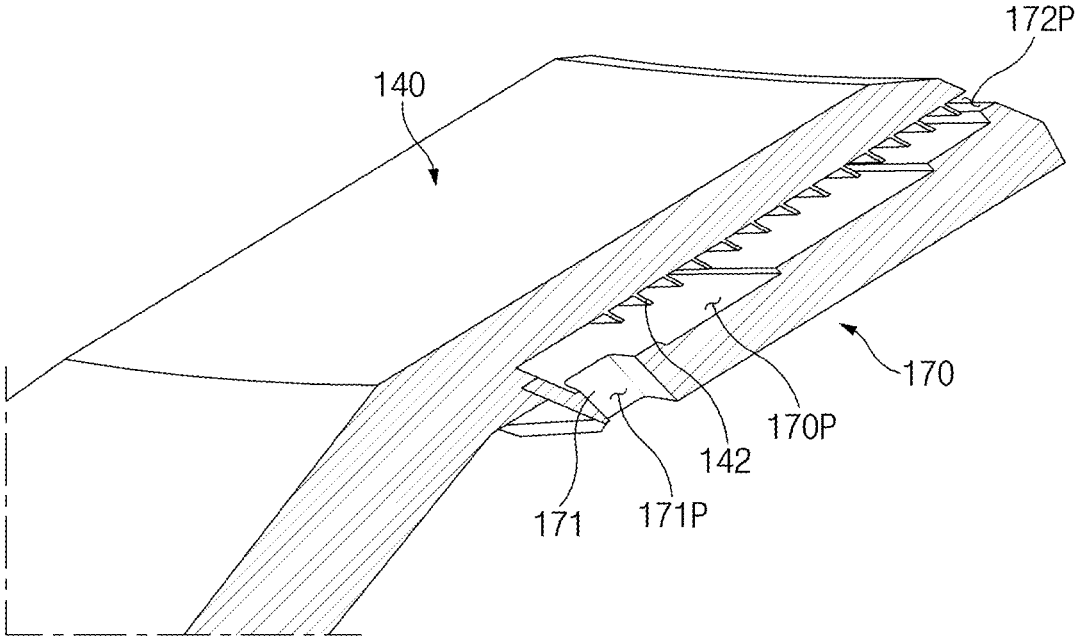
FIG. 6 is a cross-sectional perspective view made by cutting the liner and the shroud, which are illustrated in FIG. 4, in a longitudinal direction of an inlet flow path.

FIG. 4 is an enlarged cross-sectional view illustrating the liner and the shroud at the rear end portion of the liner illustrated in FIG. 2 according to an embodiment of the present disclosure. FIG. 5 is an enlarged perspective view illustrating the liner 140 and an end of a shroud 170 illustrated in FIG. 4. FIG. 6 is a cross-sectional perspective view made by cutting the liner 140 and the shroud 170, which are illustrated in FIG. 4, in a longitudinal direction of an inlet flow path 171P.

With reference to FIGS. 4 to 6, the liner 140 and the shroud 170 according to the embodiment of the present disclosure will be described.

The overlapping parts, which have been described in the comparative example, will be described again to clearly describe the embodiment of the present disclosure.

The combustor 100 may include the liner 140 configured to define the combustion chamber 140S and extending in the longitudinal direction. The combustor 100 may include the transition piece 160 that overlaps the end of the liner 140 while being spaced apart from the end of the liner 140 at a predetermined spacing distance. The transition piece 160 extends in the longitudinal direction of the liner 140. The combustor 100 may include the shroud 170 disposed between the liner 140 and the transition piece 160 and coupled to the liner 140. The liner 140 and the inner surface of the shroud 170 may define a cooling flow path 170P.

In order to solve the above-mentioned problems, the cooling efficiency of the cooling fluid flowing along the cooling flow path 170P may be improved. To this end, the cooling flow path 170P may be configured so that the air flowing in the cooling flow path 170P flows as a turbulent flow to dissipate heat from the liner 140. The flow may be classified as a laminar flow or a turbulent flow. The turbulent flow may provide significantly improved heat transfer compared to the laminar flow. The flow of air before entering the cooling flow path 170P may be configured as a laminar flow, to minimize energy loss. Only the direct flow, which cools the liner 140, may be configured as a turbulent flow, thereby significantly improving the cooling efficiency of the liner 140. The present disclosure may include all the flows as long as the flow of the cooling fluid flowing along the cooling flow path 170P is configured as the turbulent flow.

The first embodiment of the present disclosure may include the following configurations to implement the turbulent flow in the cooling flow path 170P. The first configuration is a turbulator 142 protruding toward the cooling flow path 170P. The second configuration is a swirler 171 configured to generate a swirl in the inlet flow path 171P. The third configuration is a stepped portion formed to reduce the number of cross-sections of the flow path. Because the reduction in the number of cross-sections of the flow path needs to be described in connection with the following configuration for supplying a smaller amount of air to the combustion chamber 140S, this will be described in further detail later along with the corresponding configuration.

First, the turbulator 142 will be described. The combustor 100 may further include the turbulators 142 protruding radially outwardly from the outer surface of the liner 140 or radially inwardly from the inner surface of the shroud 170 toward the cooling flow path 170P. As illustrated in FIG. 4, the turbulator 142 may protrude from the outer surface of liner 140. However, the present disclosure is not necessarily limited thereto. Therefore, the cooling fluid flowing through the cooling flow path 170P along the longitudinal direction may generate turbulent flow as it collides with the turbulators 142.

In particular, the liner 140 may include the turbulator 142. The above-mentioned liner 140 may include a flow path forming portion 141 configured to define the cooling flow path 170P. The turbulator 142 may protrude from the flow path forming portion 141. Because the turbulators 142 are intended to affect the cooling fluid flowing along the cooling flow path 170P, the turbulators 142 may be formed on the flow path forming portion 141 that defines the cooling flow path 170P.

The turbulator 142 may be formed to protrude in a direction perpendicular to the longitudinal direction of the cooling flow path 170P along which the cooling fluid flows. For example, as illustrated in FIG. 5, the turbulator 142 may extend in a circumferential direction of the liner 140. Therefore, the turbulator 142 protrudes in a direction that perpendicularly blocks (i.e., obstructs) the movement of the cooling fluid flowing along the cooling flow path 170P in the longitudinal direction of the liner 140, which may further activate or promote the transition to turbulent flow in the cooling flow path 170P.

According to an embodiment, in order to activate the transition of the cooling fluid to the turbulent flow in case that the cooling fluid flowing along the cooling flow path 170P flows in a direction having a predetermined angle with respect to the longitudinal direction of the cooling flow path 170P, an extension direction of the turbulator 142 may have a predetermined angle with respect to the longitudinal direction and the circumferential direction of the liner 140 in consideration of a predetermined angle defined between the cooling fluid and the cooling flow path 170P.

The turbulators 142 may be provided as a plurality of turbulators 142 arranged at predetermined intervals in the longitudinal direction of the cooling flow path 170P. Therefore, the transition of the cooling fluid to the turbulent flow may be implemented continuously or may be performed repeatedly in the longitudinal direction of the cooling flow path 170P. A relationship between a protrusion degree of the turbulator 142 and an interval between the plurality of turbulators 142 will be described more specifically with reference to FIGS. 7 to 8.

The shroud 170 may include the swirler 171 configured to form a swirl in the inlet flow path 171P, which is configured to communicate with an inlet of the cooling flow path 170P. Here, the term "swirl" is to be interpreted as understood by a person skilled in the art. Various structures may generate swirls, and the present disclosure encompasses all configurations capable of forming swirls. In one embodiment, as illustrated in FIG. 4 and FIG. 6, an inner surface of the swirler 171 may define the inlet flow path 171P, and the inlet flow path 171P may be formed to extend through the shroud 170 from its outer surface to its inner surface. The extension direction of the inlet flow path 171P may be inclined with respect to the longitudinal direction of the cooling flow path 170P. For example, based on FIG. 6, the inlet flow path 171P may extend in a direction made by adding a component in a leftward/rightward direction to a direction directed downward with respect to the cooling flow path 170P. That is, the inlet flow path 171P may be extended in a direction made by combining two directions perpendicular to the longitudinal direction of the cooling flow path 170P. Therefore, the direction of the cooling fluid is switched when the cooling fluid flowing along the inlet flow path 171P flows along the cooling flow path 170P, and the swirl may be formed during this process. For another example, referring to FIG. 4, the front side surface and the rear side surface of the inlet flow path 171P may have a curved shape to generate the swirl. Additionally, the swirler 171 may be formed by milling.

According to an embodiment, a distance between two farthest points on a cross-sectional area of the swirler 171 (e.g., a distance between the front side surface and the rear side surface of the inlet flow path 171P) may be equal to or larger than a height of the cooling flow path 170P. The height of the cooling flow path 170P may mean the size of the gap between the outer surface of the liner 140 and the inner surface of the shroud 170. In other words, a cross-sectional area of the inlet flow path 171P may be larger than a cross-sectional area of the cooling flow path 170P corresponding to the cross-sectional area of the inlet flow path 171P. The cross-sectional area of the inlet flow path 171P may be based on a plane perpendicular to an extension direction of the inlet flow path 171P. Because one cooling flow path 170P may correspond to several inlet flow paths 171P, an overall cross-sectional area of the cooling flow path 170P may be larger than a cross-sectional area of one inlet flow path 171P. However, a substantial flow path cross-sectional area of the actual cooling flow path 170P, along which the cooling fluid flowing out of the actual inlet flow path 171P, may be smaller than the cross-sectional area of the inlet flow path 171P. Because the cross-sectional area of the inlet flow path 171P is larger than the cross-sectional area of the cooling flow path 170P, a flow rate in the inlet flow path 171P may be lower than a flow rate in the cooling flow path 170P. That is, the pressure of the cooling fluid in the cooling flow path 170P is lower than the pressure of the cooling fluid flowing along the inlet flow path 171P. The cooling fluid may be naturally moved from the inlet flow path 171P to the cooling flow path 170P by a difference in pressure. Therefore, the cooling fluid may be naturally moved to the inlet flow path 171P without a device that provides separate driving power.

An outlet flow path 172P of the cooling flow path 170P may extend in the longitudinal direction of the cooling flow path 170P. In comparison with the comparative example, the number of outlet flow paths 172P may be reduced, and the amount of air moving to the combustion chamber 140S may be reduced. Further, the air injected into the combustion chamber 140S is injected in the longitudinal direction, in which the injected air deviates from the flame in the combustion chamber, such that the amount of air participating in the combustion reaction may be reduced. Therefore, it is possible to reduce the amount of nitrogen oxide produced in the combustion chamber 140S.

As illustrated in FIG. 4, at least a part of the cooling flow path 170P may have a section in which a cross-sectional area decreases in a direction from the upstream side to the downstream side based on a direction in which the cooling fluid configured to flow along the cooling flow path 170P flows in the cooling flow path 170P. The cross-sectional area of the cooling flow path 170P may be based on a plane perpendicular to the longitudinal direction. That is, the gap between the outer surface of the liner 140 and the inner surface of the shroud 170 may gradually narrow in stages. Therefore, it is possible to reduce the amount of air to be provided to the combustion chamber 140S. In particular, because the air flowing along the cooling flow path 170P is neither ideal air nor laminar flow, the amount of air to be provided to the combustion chamber 140S may be reduced as the cross-sectional area of the cooling flow path 170P decreases. Further, because the cross-sectional area decreases at the downstream side, the pressure of the cooling fluid is lower at the downstream side than at the upstream side, like the above-mentioned relationship between the inlet flow path 171P and the cooling flow path 170P, such that the air may be naturally moved from the upstream side to the downstream side by the difference in pressure.

The cross-sectional area of the cooling flow path 170P may decrease by at least one stepped portion 174. Therefore, the transition of the flow of the cooling fluid to the turbulent flow may be further activated. Further, the process of reducing the cross-sectional area may be facilitated by forming the stepped portion. For example, one surface of the shroud 170 configured to define the cooling flow path 170P may be referred to as a first cooling flow path surface 170Aa, and one surface of the shroud 170 positioned at a downstream side of the first cooling flow path surface 170Aa may be referred to as a second cooling flow path surface 170Ab. In this case, the second cooling flow path surface 170Ab may be positioned to be closer to the liner 140 than the first cooling flow path surface 170Aa to the liner 140. In other words, the distance between the liner 140 and the first cooling flow path surface 170Aa may be larger than the distance between the liner 140 and the second cooling flow path surface 170Ab. Further, the first cooling flow path surface 170Aa may be positioned adjacent to the second cooling flow path surface 170Ab while forming the stepped portion 174 together with the second cooling flow path surface 170Ab. In other words, a stepped portion 174 may be formed between the first cooling flow path 170Aa and the second cooling flow path 170Ab.

The section in which the cross-sectional area of the cooling flow path 170P decreases may correspond to a section in which the turbulators 142 are formed. That is, the plurality of turbulators 142 may be formed in the section in which the cross-sectional area of the cooling flow path 170P decreases. As illustrated in FIG. 4, a portion of the cooling flow path 170P connected directly to the inlet flow path 171P may have a larger cross-sectional area than a portion disposed at a downstream side of the cooling flow path 170P. The turbulators 142 may be formed at a portion where the cross-sectional area decreases in the direction directed toward the downstream side. This is because the cross-sectional area needs to decrease and the turbulent flow needs to be formed to reduce the amount of air flowing to the combustion chamber 140S.

With reference to FIG. 5, the combustor according to the present disclosure may further include a strut 173 disposed between the shroud 170 and the liner 140 and configured to support the shroud 170 and the liner 140. The strut 173 may have a cylindrical shape. The strut 173 may be positioned at the downstream side of the cooling flow path 170P. That is, the strut 173 may be formed adjacent to the outlet flow path 172P. As illustrated in FIG. 4, because the shroud 170 and the liner 140 structurally combines each other at the front end side of the shroud 170, the structural interval or gap between the liner 140 and the shroud 170 at the front end side of the cooling flow path 170P is relatively better maintained without struts. However, because the liner 140 and the shroud 170 do not structurally combine or support each other at the rear side end of the cooling flow path 170P, the strut 173 is provided to maintain the height of the cooling flow path 170P and the gap or intervale between the liner 140 and the shroud 170.

Figure 7:
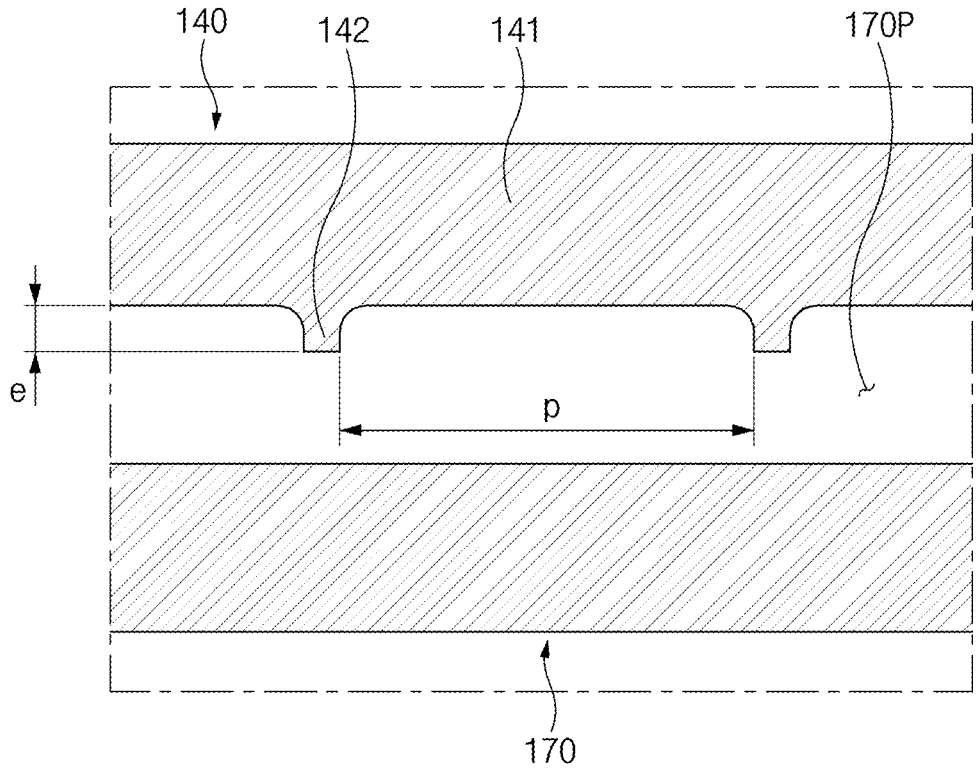
FIG. 7 is an enlarged cross-sectional view illustrating a turbulator illustrated in FIG. 4.
Figure 8:
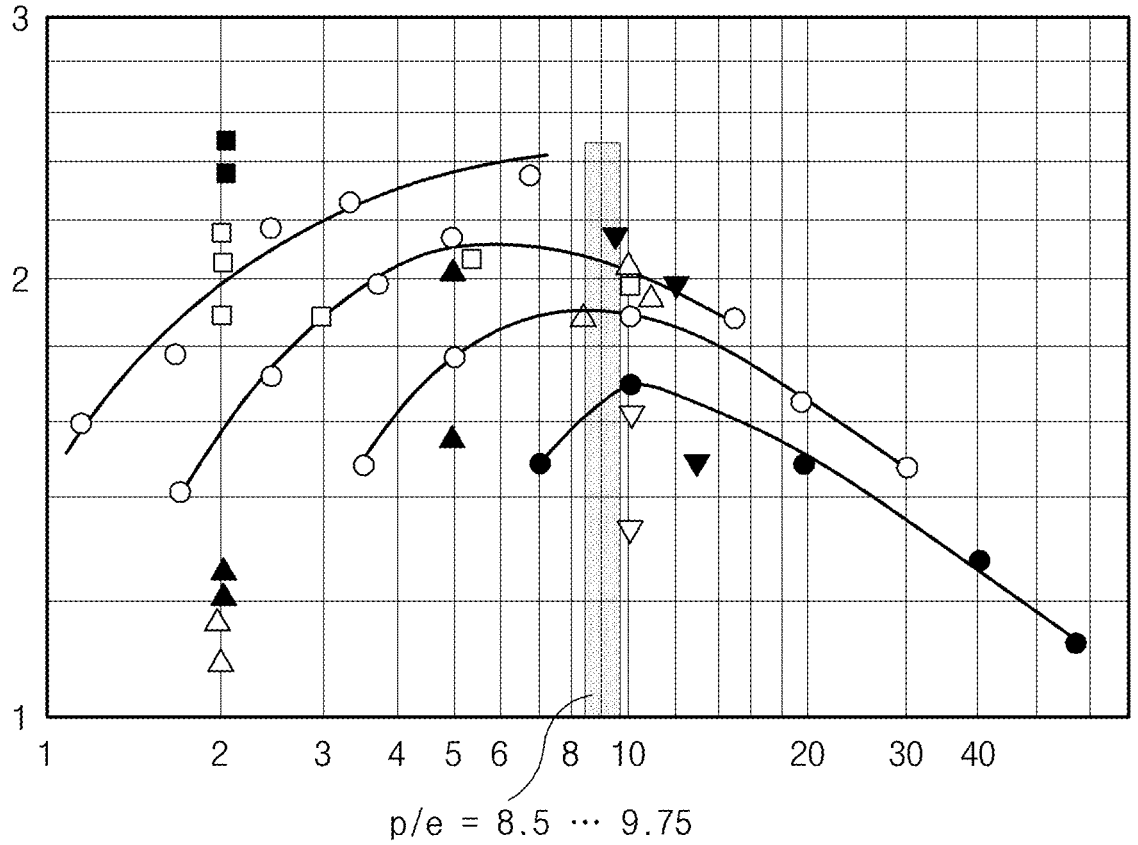
FIG. 8 is a graph related to cooling efficiency with respect to protruding heights of and intervals between a plurality of turbulators illustrated in FIG. 7.

FIG. 7 is an enlarged cross-sectional view illustrating the turbulators 142 illustrated in FIG. 4. FIG. 8 is a graph related to cooling efficiency with respect to protruding heights of and intervals between the plurality of turbulators 142 illustrated in FIG. 7.

The turbulator 142 according to the embodiment of the present disclosure will be described with reference to FIGS. 7 to 8.

As illustrated in FIG. 4, the turbulators 142 may be provided as a plurality of turbulators 142. Of course, the protruding heights of the plurality of turbulators 142 may be different from one another, and the intervals between the adjacent turbulators 142 may also be different from one another. However, hereinafter, the description will be based on the assumption that the protruding heights of the turbulators 142 are equal to one another, and the intervals between the adjacent turbulators 142 are also equal to one another.

A length by which each of the plurality of turbulators 142 protrudes may be defined as e, and an interval between the plurality of turbulators 142 may be defined as p. FIG. 8 is a graph that summarizes experiments performed to find efficient values of e and p. The x-axis corresponds to a value of p/e, and the y-axis corresponds to the Nusselt number. More specifically, the ratios of the Nusselt numbers indicated on the y-axis are made by dividing the Nusselt number in the turbulent flow by the Nusselt number in the laminar flow. It can be seen that the cooling efficiency increases as the ratio of the Nusselt numbers increases. With reference to the graph, it can be seen that the cooling efficiency is high when the ratio of e to p is 8 or more and 10 or less. Therefore, the ratio of e to p according to the embodiment of the present disclosure may be 8 or more and 10 or less.

Hereinafter, embodiments different from the first embodiment will be described. The contents common to those in the first embodiment will be omitted as much as possible, and the description of the other embodiments will focus on the differences. That is, it is evident that the contents, not described in the other embodiments, may be supplemented by the contents in the first embodiment, where appropriate.

Second Embodiment

Figure 9:
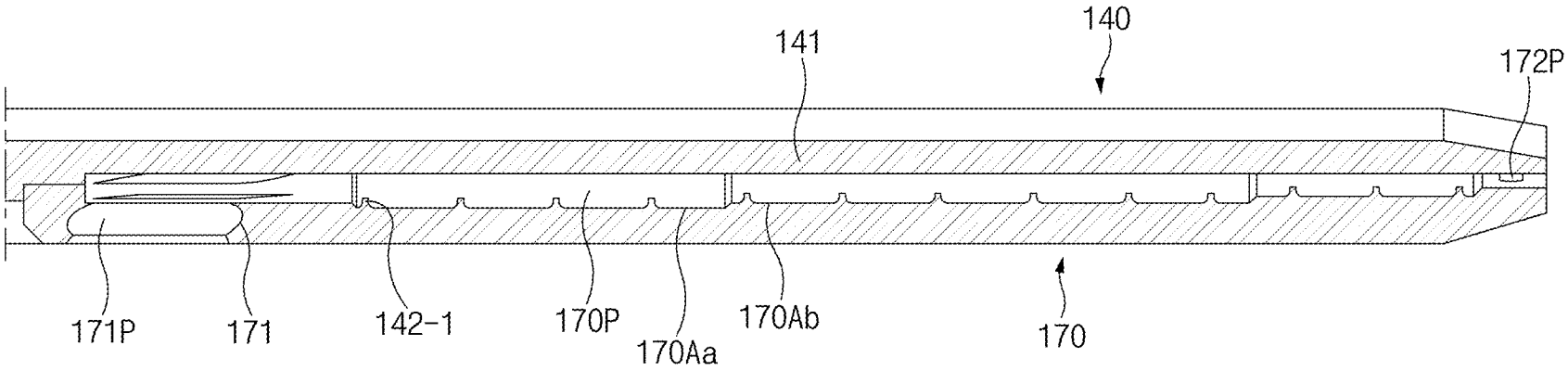
FIG. 9 is a cross-sectional view illustrating a liner and a shroud according to a second embodiment of the present disclosure.

FIG. 9 is a cross-sectional view illustrating the liner 140 and the shroud 170 according to the second embodiment of the present disclosure.

A turbulator 142-1 according to the second embodiment of the present disclosure will be described with reference to FIG. 9.

The second embodiment differs from the first embodiment in terms of an extension starting position of the turbulator 142-1.

The turbulator 142-1 may extend from the shroud 170 rather than from the liner 140. In this case, the shroud 170 and the turbulator 142-1 may be integrated.

Third Embodiment

Figure 10:
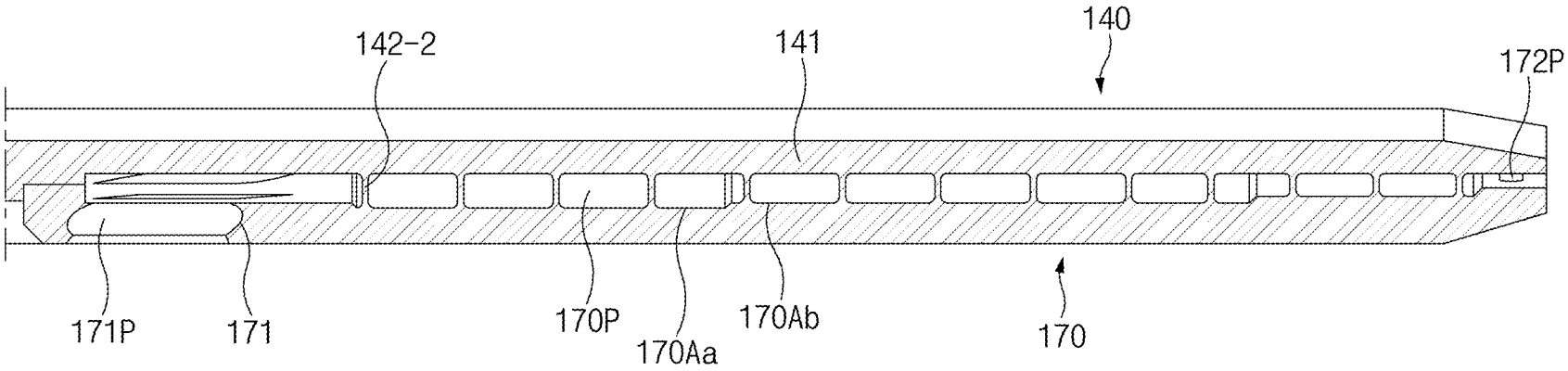
FIG. 10 is a cross-sectional view illustrating a liner and a shroud according to a third embodiment of the present disclosure.

FIG. 10 is a cross-sectional view illustrating the liner 140 and the shroud 170 according to the third embodiment of the present disclosure.

A turbulator 142-2 according to the third embodiment of the present disclosure will be described with reference to FIG. 10.

The third embodiment differs from the first embodiment in that the shape of the turbulator 142-2 in the third embodiment differs from that in the first embodiment.

The turbulator 142-2 may extend from the liner 140 to the shroud 170. In this case, the turbulator 142-2 may have at least one hole through which the cooling fluid may pass. The turbulator 142-2 may be in the form of an annual panel having the at least one hole.

The hole of the turbulator 142, through which the cooling fluid may pass, may be formed at a height in the radial direction different from that of the hole of the adjacent turbulator 142-2, such that the transition of the cooling fluid to the turbulent flow may be further activated.

Fourth Embodiment

Figure 11:
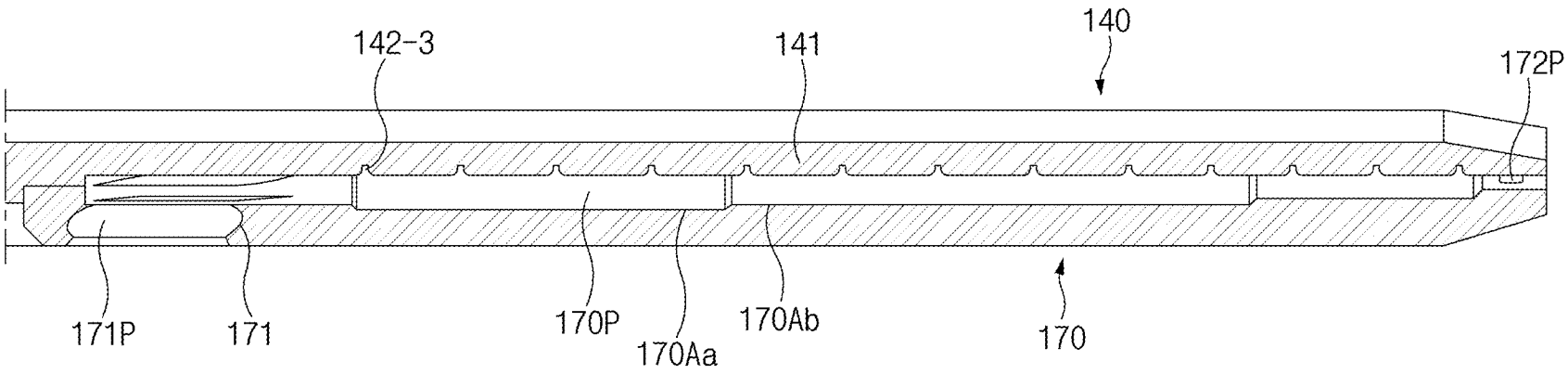
FIG. 11 is a cross-sectional view illustrating a liner and a shroud according to a fourth embodiment of the present disclosure.

FIG. 11 is a cross-sectional view illustrating the liner 140 and the shroud 170 according to the fourth embodiment of the present disclosure.

A turbulator 142-3 according to the fourth embodiment of the present disclosure will be described with reference to FIG. 11.

The fourth embodiment differs from the first embodiment in that the shape of the turbulator 142-3 in the fourth embodiment differs from that in the first embodiment.

The turbulator 142-3 may be provided as a concave groove. The turbulator 142-3 may be provided as a groove so that the cooling fluid accommodated in the groove may transition to the turbulent flow. The turbulator 142-3 in the third embodiment is advantageous in reducing a loss of energy of the fluid in comparison with the turbulator 142 in the first embodiment.

Fifth Embodiment

Figure 12:
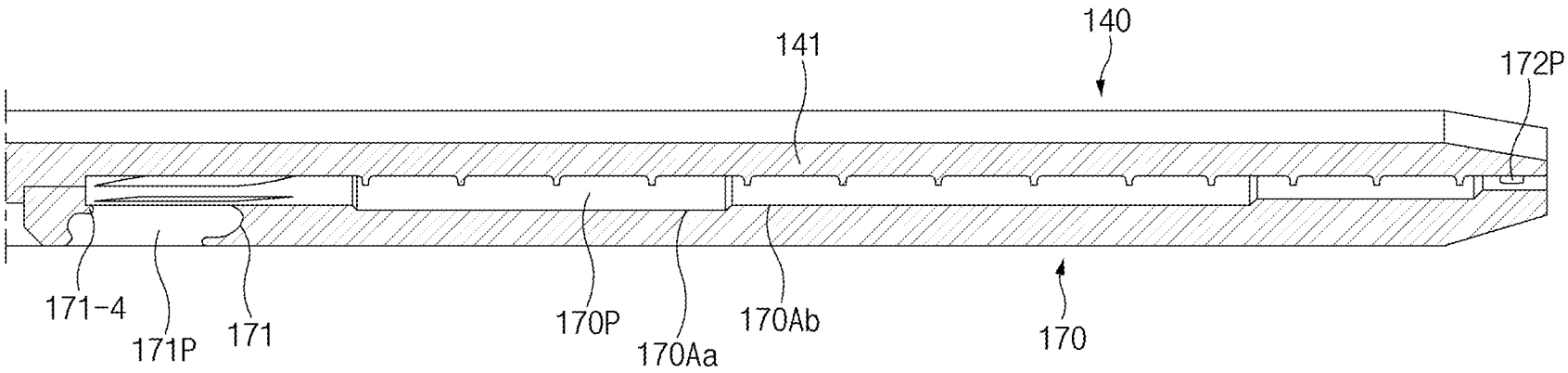
FIG. 12 is a cross-sectional view illustrating a liner and a shroud according to a fifth embodiment of the present disclosure.

FIG. 12 is a cross-sectional view illustrating the liner 140 and the shroud 170 according to the fifth embodiment of the present disclosure.

A swirler 171-4 according to the fifth embodiment of the present disclosure will be described with reference to FIG. 12.

The fifth embodiment differs from the first embodiment in that the shape of the swirler 171-4 in the fifth embodiment differs from that in the first embodiment.

The swirler 171-4 may have a protruding shape. The swirler 171-4 may have a protruding shape. The swirler 171-4 may extend in a direction that is rotational with respect to the extended direction of the inlet flow path 171P, using the extended direction of the inlet flow path 171P as the axis of rotation, and may have a shape that protrudes toward the axis of rotation.

Further, the swirler 171-4 may have a groove shape. The above-mentioned description of the extension direction of the protruding shape may be equally applied to the extension direction of the groove.

Sixth Embodiment

Figure 13:
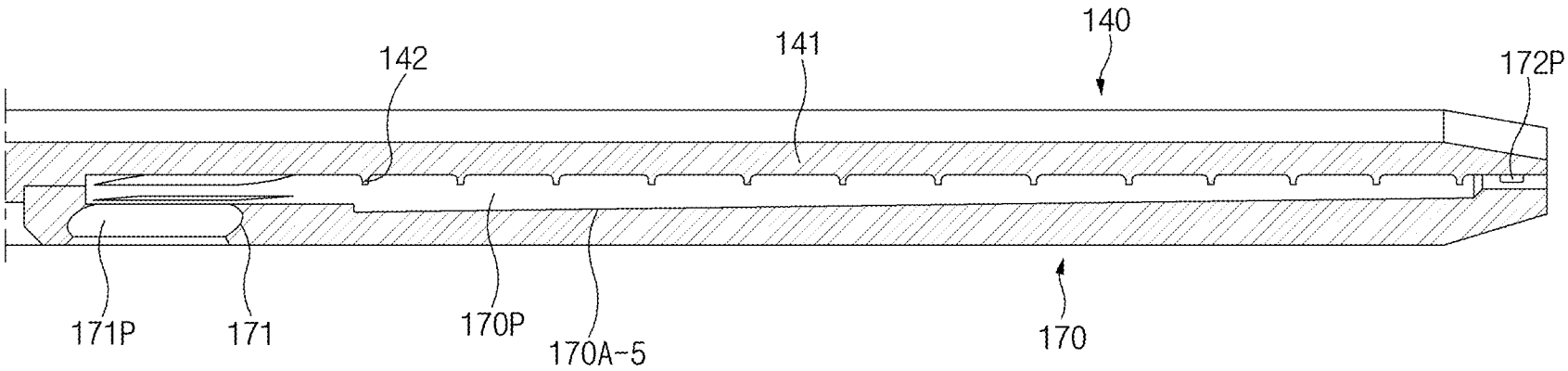
FIG. 13 is a cross-sectional view illustrating a liner and a shroud according to a sixth embodiment of the present disclosure.

FIG. 13 is a cross-sectional view illustrating the liner 140 and the shroud 170 according to the sixth embodiment of the present disclosure.

A cooling flow path surface 170A-5 according to the sixth embodiment of the present disclosure will be described with reference to FIG. 13.

The sixth embodiment differs from the first embodiment in that a method of reducing the cross-sectional area of the cooling flow path 170P does not form a stepped portion.

The cooling flow path 170P may include a section in which a cross-sectional area gradually decreases from the upstream side to the downstream side without a stepped portion. To this end, the cooling flow path surface 170A-5 of the shroud 170 may become closer to the liner 140 toward the downstream side. As illustrated in FIG. 13, the cooling flow path surface 170A-5 may be inclined linearly. Alternatively, the cooling flow path surface 170A-5 may have a curved surface having a variable gradient, unlike the configuration illustrated in FIG. 13.

Seventh Embodiment

Figure 14:
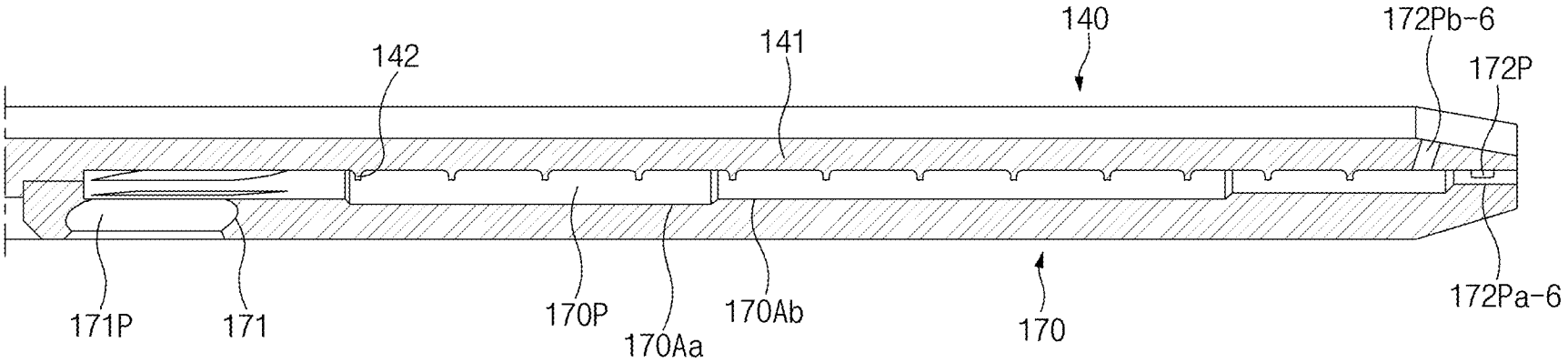
FIG. 14 is a cross-sectional view illustrating a liner and a shroud according to a seventh embodiment of the present disclosure.

FIG. 14 is a cross-sectional view illustrating the liner 140 and the shroud 170 according to the seventh embodiment of the present disclosure.

The outlet flow path 172P according to the seventh embodiment of the present disclosure will be described with reference to FIG. 14.

The seventh embodiment differs from the first embodiment in that the number of outlet flow paths 172P and the direction of the outlet flow path 172P are different from those in the first embodiment.

The outlet flow path 172P may include a first outlet flow path 172Pa-6 described in the first embodiment, and a second outlet flow path 172Pb-6 extending at a predetermined angle with respect to an extension direction of the first outlet flow path 172Pa-6. Because the extension direction of the second outlet flow path 172Pb-6 is directed toward the combustion chamber 140S, the second outlet flow path 172Pb-6 may introduce the air toward the flame.

Unless explicitly stated otherwise, the embodiments described above may be combined with other embodiments. Alternatively, unless it is clearly limited in combining one embodiment with another embodiment, it should be interpreted that combinations of embodiments are possible. The combination of any embodiment and another embodiment is considered to be disclosed herein. In other words, any one feature of an embodiment of the present disclosure described in the specification may be applied to another embodiment of the present disclosure. Similarly, the present invention encompasses any embodiment that combines features of one embodiment and features of another embodiment.

The present disclosure has been described with reference to the limited embodiments and the drawings, but the present disclosure is not limited thereby. The present disclosure may be carried out in various forms by those skilled in the art, to which the present disclosure pertains, within the technical spirit of the present disclosure and the scope equivalent to the appended claims.

DESCRIPTION OF REFERENCE NUMERALS

1: Gas turbine
10: Compressor
20: Turbine
100: Combustor
110: Nozzle
111: Nozzle housing
140: Liner
140S: Combustion chamber
141: Flow path forming portion
142: Turbulator
150: Flow sleeve
160: Transition piece
170: Shroud
170P: Cooling flow path
170A: Cooling flow path surface
170Aa: First cooling flow path surface
170Ab: Second cooling flow path surface
171: Swirler
171P: Inlet flow path
172P: Outlet flow path
172Pa: First outlet flow path
172Pb: Second outlet flow path
173: Strut

What is claimed is:

1. A combustor comprising:

a liner configured to define a combustion chamber and extending in a longitudinal direction;

a transition piece configured to overlap an end of the liner while being spaced apart from the end of the liner at a predetermined spacing distance, the transition piece extending in the longitudinal direction of the liner; and a shroud disposed between the liner and the transition piece and coupled to the liner, wherein the liner and an inner surface of the shroud define a cooling flow path, and wherein the cooling flow path is formed with a turbulator to allow a cooling air, which flows in the cooling flow path, to flow as a turbulent flow in order to dissipate heat from the liner, wherein, when a radial direction is defined as a direction extending from a center of the combustion chamber toward a circumferential periphery of the liner, the shroud includes a narrowing stepped portion formed on the inner surface of the shroud, the narrowing stepped portion being configured such that a radial distance between the liner and the inner surface of the shroud decreases from an upstream side to a downstream side along a flow direction of the cooling air flowing through the cooling flow path.

2. The combustor of claim 1, wherein the turbulator protrudes from the liner toward the cooling flow path.

3. The combustor of claim 2, wherein the turbulator is included in the liner, and the liner comprises a flow path forming portion configured to define the cooling flow path, and the turbulator protrudes from the flow path forming portion.

4. The combustor of claim 2, wherein the turbulator is formed to protrude perpendicularly to a longitudinal direction of the cooling flow path.

5. The combustor of claim 2, wherein the turbulator is provided as a plurality of turbulators arranged at predetermined intervals in a longitudinal direction of the cooling flow path.

6. The combustor of claim 5, wherein, when a length by which each of the plurality of turbulators protrudes is defined as e, and an interval between the plurality of turbulators is defined as p, a ratio of e to p is 8 or more and 10 or less.

7. The combustor of claim 1, wherein the shroud comprises a swirler in an inlet flow path to form a swirl in the inlet flow path, which communicates with an inlet of the cooling flow path.

8. The combustor of claim 7, wherein an inner surface of the swirler defines the inlet flow path, and the inlet flow path has an extension direction inclined with respect to a longitudinal direction of the cooling flow path.

9. The combustor of claim 7, wherein the inlet flow path has an extension direction that is a direction made by combining two directions perpendicular to a longitudinal direction of the cooling flow path.

10. The combustor of claim 7, wherein a distance between two farthest points on a cross-sectional area of the swirler is equal to or larger than a height of the cooling flow path.

11. The combustor of claim 1, wherein an outlet flow path of the cooling flow path extends in a longitudinal direction of the cooling flow path.

12. The combustor of claim 1, wherein at least a part of the cooling flow path has a section in which a cross-sectional area decreases from the upstream side to the downstream side.

13. The combustor of claim 12, wherein the section in which the cross-sectional area of the cooling flow path decreases is provided where the narrowing stepped portion is formed.

14. The combustor of claim 12, wherein the turbulator protrudes from the liner toward the cooling flow path, wherein the section in which the cross-sectional area of the cooling flow path decreases corresponds to a section in which the turbulator is formed.

15. The combustor of claim 1, further comprising:

a strut disposed at a rear side of the liner and between the shroud and the liner and configured to support the shroud and the liner.

16. The combustor of claim 1, wherein the turbulator is provided as a plurality of turbulators along the flow direction of the cooling air, which protrude from the liner toward the cooling flow path, and wherein the narrowing stepped portion is provided as a plurality of narrowing stepped portions along the flow direction of the cooling air, wherein, when the longitudinal direction is defined as the direction from the upstream side to the downstream along the flow direction of the cooling air flowing, a longitudinal position of each of the plurality of narrowing stepped portions corresponds to a longitudinal position of one of the plurality of turbulators.

17. The combustor of claim 1, wherein the narrowing stepped portion is provided as a plurality of narrowing stepped portions arranged along the flow direction of the cooling air through the cooling flow path, wherein the shroud further includes a single entry stepped portion formed on the inner surface of the shroud, the single entry stepped portion being disposed upstream of all of the plurality of narrowing stepped portions with respect to the flow direction of the cooling air such that the single entry stepped portion being closer to an inlet of the cooling flow path than said all of the plurality of narrowing stepped portions, and wherein the single entry stepped portion is configured such that the radial distance between the liner and the inner surface of the shroud increases from the upstream side to the downstream side along the flow direction of the cooling air flowing through the cooling flow path.

18. A gas turbine comprising:

a compressor;

a turbine configured to produce electric power by using air compressed by the compressor; and a combustor configured to combust the air compressed by the compressor, wherein the combustor comprises:

a liner configured to define a combustion chamber and extending in a longitudinal direction;

a transition piece configured to overlap an end of the liner while being spaced apart from the end of the liner at a predetermined spacing distance, the transition piece extending in the longitudinal direction of the liner; and a shroud disposed between the liner and the transition piece and coupled to the liner, wherein the liner and an inner surface of the shroud define a cooling flow path, and wherein the cooling flow path is formed with a turbulator to allow a cooling air, which flows in the cooling flow path, to flow as a turbulent flow in order to dissipate heat from the liner, wherein, when a radial direction is defined as a direction extending from a center of the combustion chamber toward a circumferential periphery of the liner, the shroud includes a narrowing stepped portion formed on the inner surface of the shroud, the narrowing stepped portion being configured such that a radial distance between the liner and the inner surface of the shroud decreases from an upstream side to a downstream side along a flow direction of the cooling air flowing through the cooling flow path.

* * * * *